US009124033B2

(12) United States Patent
Hirano

(10) Patent No.: US 9,124,033 B2
(45) Date of Patent: Sep. 1, 2015

(54) LEVER-TYPE CONNECTOR

(71) Applicant: Sumitomo Wiring Systems, Ltd., Yokkaichi, Mie (JP)

(72) Inventor: Shinji Hirano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 22 days.

(21) Appl. No.: 14/103,058

(22) Filed: Dec. 11, 2013

(65) Prior Publication Data

US 2014/0206222 A1 Jul. 24, 2014

(30) Foreign Application Priority Data

Jan. 23, 2013 (JP) ..... 2013-009891

(51) Int. Cl.
*H01R 13/62* (2006.01)
*H01R 13/629* (2006.01)

(52) U.S. Cl.
CPC ..... *H01R 13/62955* (2013.01)

(58) Field of Classification Search
CPC ..... H01R 13/62938
USPC ..... 439/157, 372
See application file for complete search history.

(56) References Cited

FOREIGN PATENT DOCUMENTS

JP 2003-297481 10/2003
JP 2003297481 A * 10/2003 ..... H01R 13/629

* cited by examiner

*Primary Examiner* — Abdullah Riyami
*Assistant Examiner* — Thang Nguyen
(74) *Attorney, Agent, or Firm* — Gerald E. Hespos; Michael J. Porco; Matthew T. Hespos

(57) ABSTRACT

A lever-type connector is configured so that a lock piece (65) of a lock (60) resiliently locks a locked portion (49) to hold a lever (50) at an end position when the lever (50) is rotated to the end position. The locked portion (49) is released from a locked state and the lever (50) is permitted to rotate toward an initial position by pulling up an unlocking portion (70) and forcibly deflecting the lock piece (65). Entrance restricting projections (75) project from facing surfaces of the protection walls (70) on an end position side of the unlocking portion (70) of the lock piece (65) in the lock (60).

11 Claims, 9 Drawing Sheets

LEVER-TYPE CONNECTOR

BACKGROUND

1. Field of the Invention

The invention relates to a lever-type connector.

2. Description of the Related Art

Japanese Unexamined Patent Publication No. 2003-297481 discloses a lever-type connector with a housing. A terminal fitting connected to an end of a wire can be inserted into the housing from behind. The connector also has a U-shaped lever with two arms extending from opposite ends of an operating portion. The arms are mounted rotatably on side surfaces of the housing. Each arm has a cam groove configured to enable connection with a mating housing as the lever is rotated from an initial position to an end position. A locked portion protrudes from the rear surface of the housing, and a lock is provided on the operating portion of the lever. The lock includes a resiliently deflectable cantilevered lock piece and an unlocking portion on a tip of the lock piece. Protection walls stand at opposite sides of the lock piece.

The lock piece of the lock resiliently locks the locked portion when the lever is rotated to the end position and holds the lever at the end position. The unlocking portion can be pulled up to deflect the lock piece and thereby releasing the locked portion so that the lever can be rotated toward the initial position.

The wire drawn out from the rear surface of the housing may be pulled up toward the locked portion and an intermediate part of the wire may contact and deflect the unlocking portion of the lock piece, thereby inadvertently deflecting the lock piece and releasing a locked state.

The invention was completed based on the above situation and aims to prevent a lever from being unlocked inadvertently due to a wire, external matter or the like.

SUMMARY OF THE INVENTION

The invention relates to a lever-type connector that includes a housing, and a terminal fitting connected to an end of a wire can be inserted into the housing from behind. The connector also includes a lever with an operating portion and two arms extending from the operating portion to define a U-shape. The arms of the lever are mounted rotatably on side surfaces of the housing. Each arm has a cam groove configured to enable connection with a mating housing while the lever is rotated from an initial position to an end position. A locked portion protrudes from a rear surface of the housing. A lock is provided on the operating portion of the lever and includes a resiliently deflectable cantilevered lock piece with an unlocking portion on a tip. Protection walls stand on opposite sides of the lock piece in a direction perpendicular to a deflecting direction with clearances defined between the protection walls and the lock piece. The lock piece of the lock engages the locked portion to hold the lever at the end position. The locked state is released by pulling up the unlocking portion and resiliently deflecting the lock piece so that the lever can rotate toward the initial position. Entrance restricting projections are formed on facing surfaces of the protection walls near the unlocking portion of the lock piece.

The wire drawn out from the rear surface of the housing may be pulled toward the locked portion and may try to enter into a front opening between the protection walls on opposite sides of the lock piece when the lever is locked at the end position. However, the wire will contact the entrance restricting projections on the facing surfaces of the protection walls, thereby restricting entrance of the wire. The entrance restricting portions also will restrict entrance of a finger of an operator or external matter that moves toward the front opening between the protection walls.

Specifically, the entrance restricting portions narrow the front opening between the protection walls and restrict entry of the pulled wire, external matter or the like. Thus, the unlocking portion at the tip of the lock piece will not be displaced in an unlocking direction and the lock piece remains engaged with the locked portion. Accordingly, the locked state will not be released inadvertently by the pulled wire, external matter or the like.

The entrance restricting portions may be arranged to overlap opposite side edges of the unlocking portion when the housing is viewed from behind in a state where the lever is held at the end position.

DETAILED DESCRIPTION OF THE PREFERRED EMBODIMENTS

Figure 1:
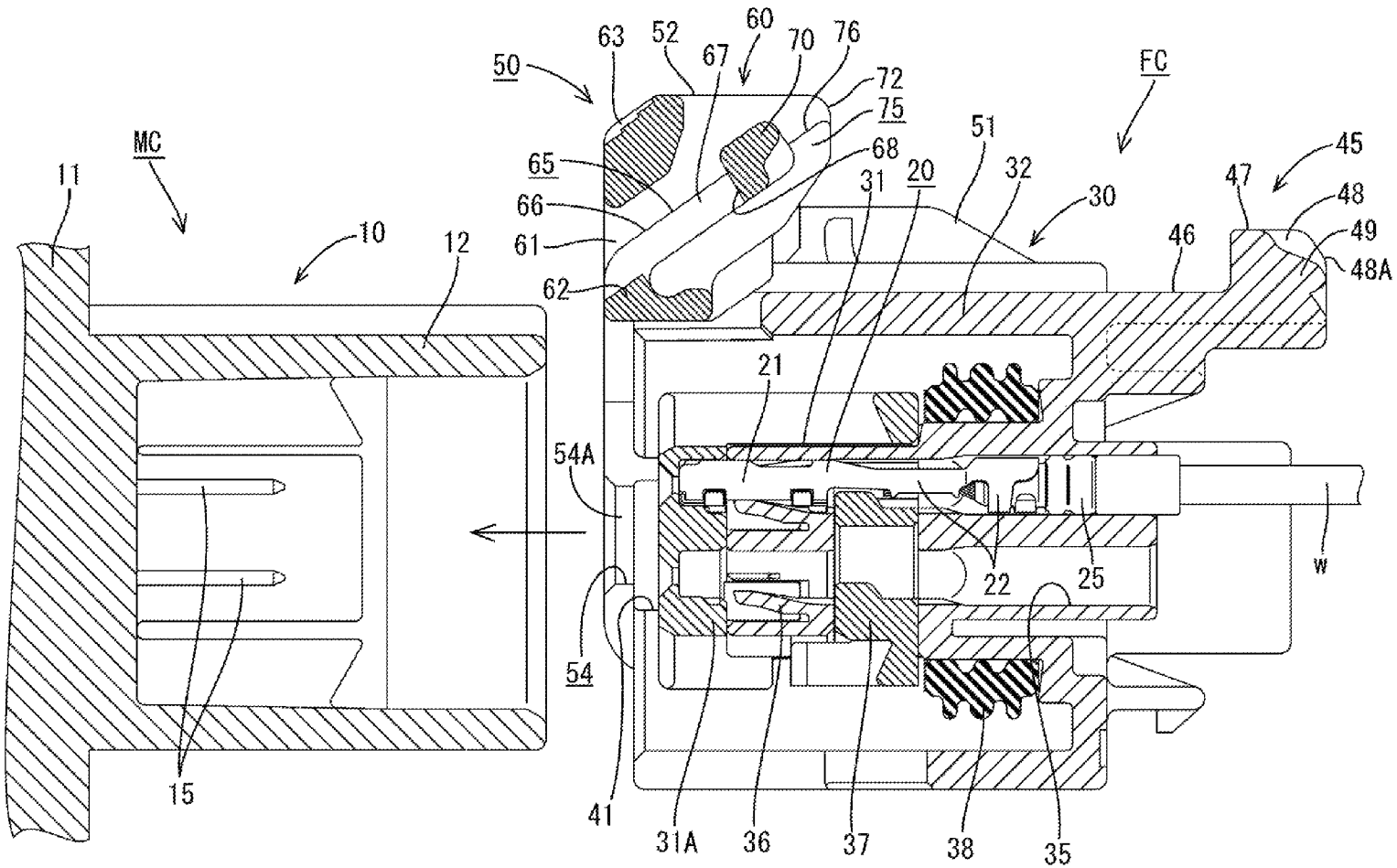
FIG. 1 is a longitudinal section showing a state before male and female connectors according to one embodiment of the present invention are connected.

A lever-type the female connector in accordance with the invention is identified by the letters FC in FIG. 1 and is configured to be connected to a male connector MC. In the following description, connecting surfaces of the connectors MC, FC are referred to as the front.

The male connector MC is a device-side connector and has a male housing 10 that projects from a device case 11 made of synthetic resin. The male housing 10 a wide rectangular small receptacle 12 and tab-shaped male terminals 15 project from the back surface of the small receptacle 12 of the male housing 10. Unillustrated cam pins project on left and right side surfaces of the small receptacle 12.

As shown in FIGS. 1 to 5, the female connector FC includes a female housing 30 made of synthetic resin, female terminals 20 accommodated in the female housing 30 and a lever 50 made of synthetic resin to assist connection and separation of the male and female housings 10 and 30.

A connecting portion 21 is provided at the front of each female terminal 20 and is configured to be connected to the male terminal 15. A barrel 22 is provided at the rear of each female terminal 20 and is configured to be connected to an end of a wire w together with a rubber plug 25.

The female housing 30 has a terminal accommodating portion 31 that can fit into the above small receptacle 12 of the male housing 10 while defining a clearance therebetween. A large receptacle 32 surrounds most of a front end of the terminal accommodating portion 31 and can fit on the outer periphery of the small receptacle 12 of the male housing 10.

Figure 3:
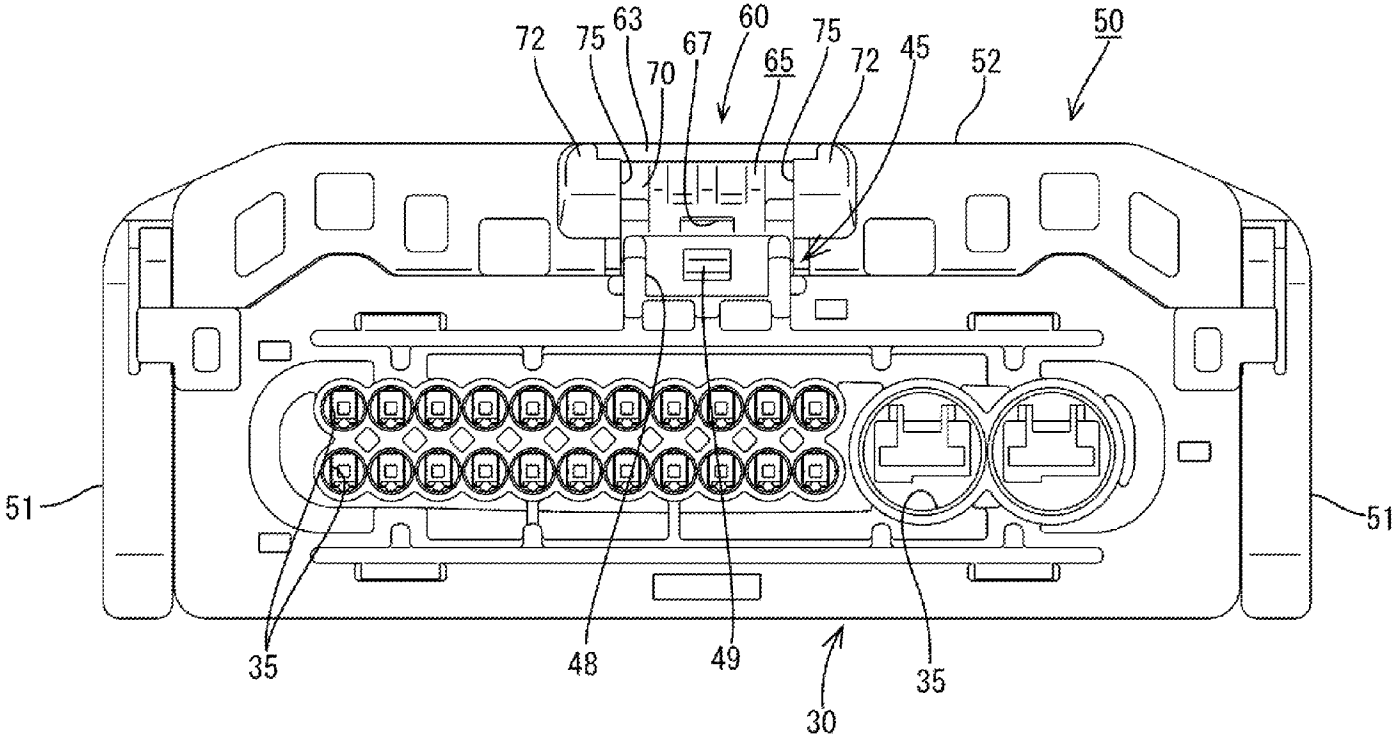
FIG. 3 is a rear view showing the state of FIG. 2.

A front wall 31A is assembled as a separate piece with the terminal accommodating portion 31. As shown in FIG. 3, cavities 35 are formed in an array corresponding to the male terminals 15 in the terminal accommodating portion 31. The female terminals 20 connected to the ends of the wires w are inserted into the respective cavities 35 from behind and are locked primarily by resin locking lances 36 at the bottom surfaces of the cavities 35. A retainer 37 is fit to the female housing 30 after insertion of all of the female terminals 20 to achieve secondary locking of the female terminals 20. In addition, the rubber plugs 25 are fit tightly into the entrances of the cavities 35.

A seal ring 38 is mounted on a base end of the terminal accommodating portion 31 and is retained in the large receptacle 32 by the front wall 31A and retainer 37.

The lever 50 is made of synthetic resin and has left and right plate-like arms 51 projecting from an operating portion 52 to define a U shape. The arms 51 of the lever 50 are mounted to straddle the female housing 30 and are supported rotatably on support shafts 40 (see FIG. 5) that project from left and right side surfaces of the large receptacle 32. Specifically, the lever 50 is rotatable between an initial position where the operating portion 52 is in front of and above the support shafts 40, as shown in solid line in FIGS. 1 and 5, and an end position where the operating portion 52 is behind and above the support shafts 40, as shown in chain line in FIGS. 8 and 5.

Curved cam grooves 54 are formed on the inner surfaces of the arms 51 of the lever 50 (see FIGS. 1 and 8) and the cam pins projecting on the side surfaces of the small receptacle 12 of the male housing 10 fit into the cam grooves 54 through escape grooves 41 (see FIG. 2) in the left and right side walls of the large receptacle 32. Entrances 54A of the cam grooves 54 open forward when the lever 50 is at the initial position, as shown in FIG. 1, so that the cam pins of the male housing 10 can enter the cam grooves 54 as the male and female housings 10, 30 are connected.

Figure 2:
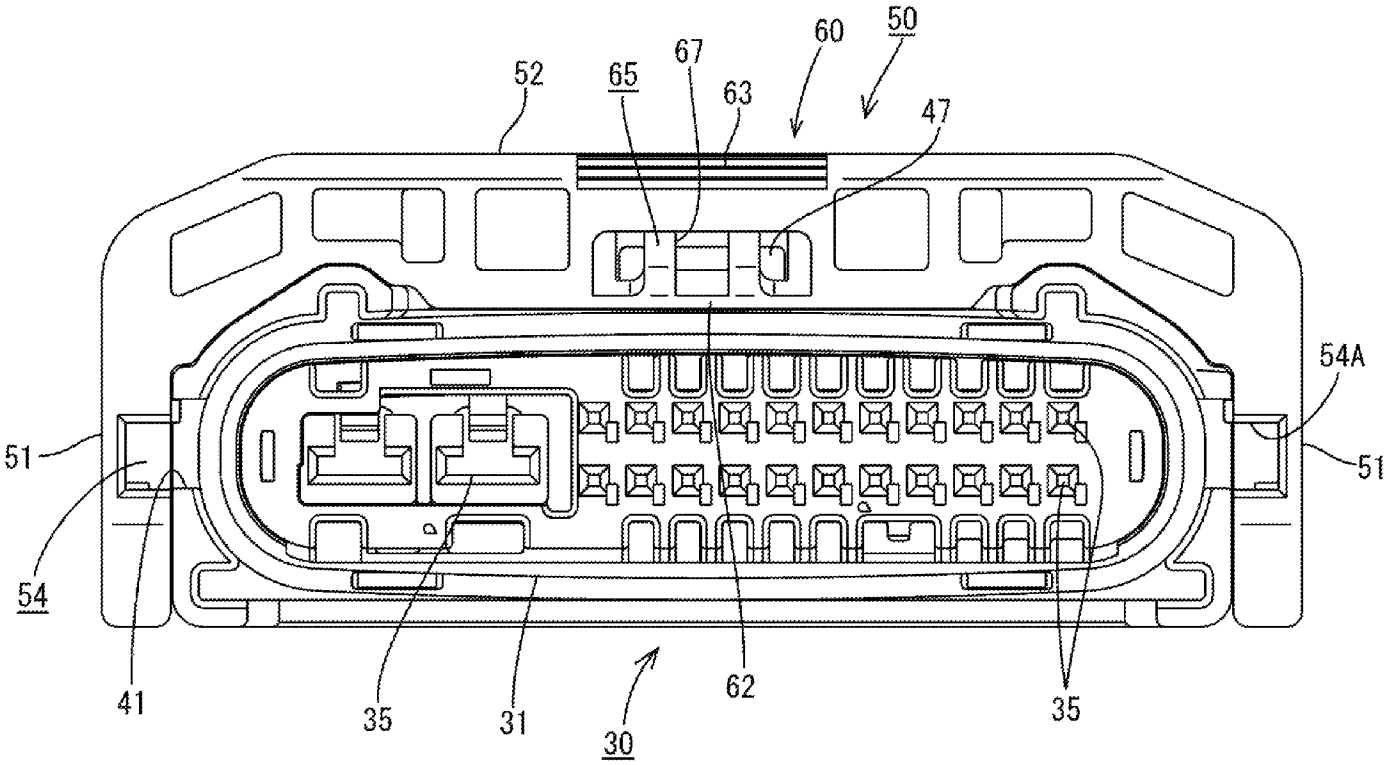
FIG. 2 is a front view showing a state where a lever is mounted at an initial position on a female housing.
Figure 4:
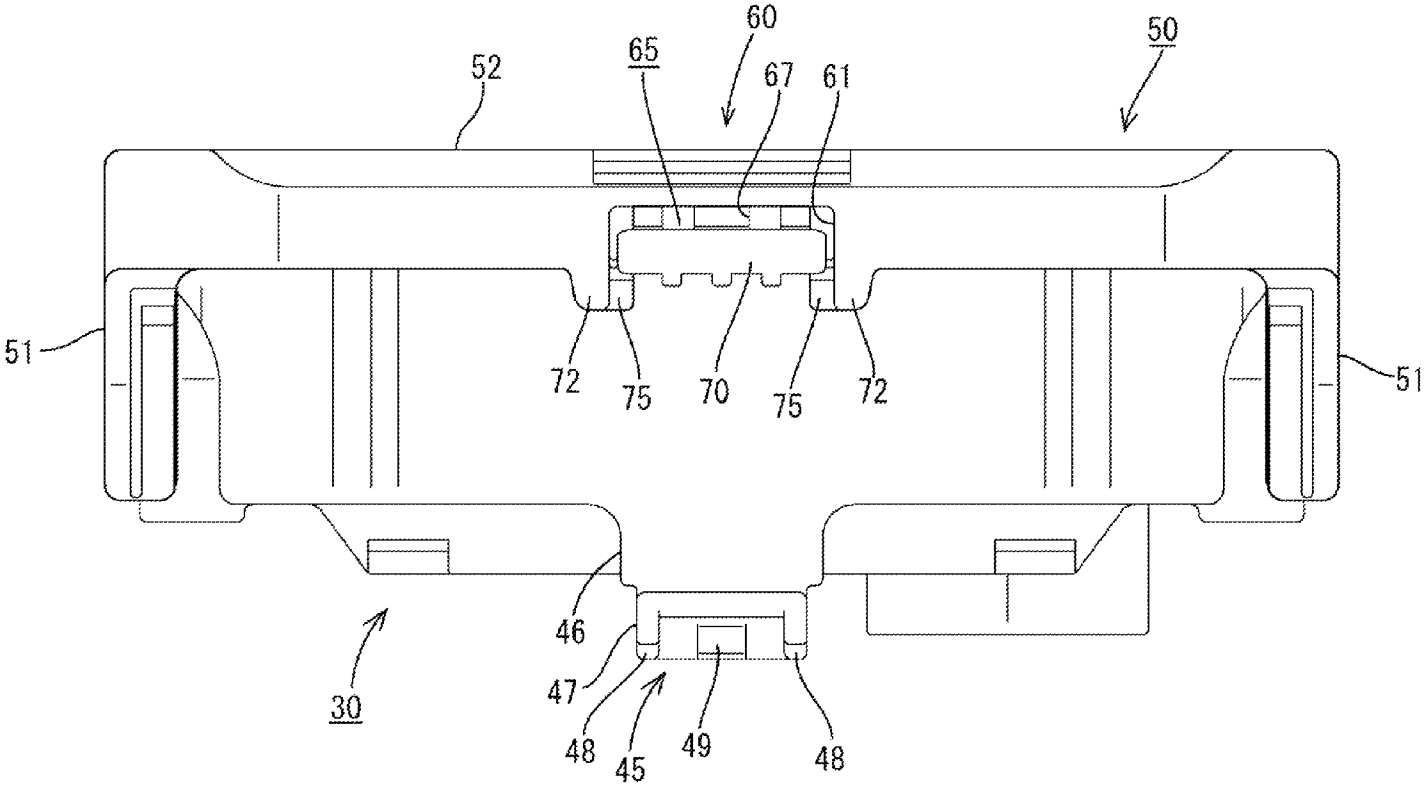
FIG. 4 is a plane view showing the state of FIG. 2.
Figure 5:
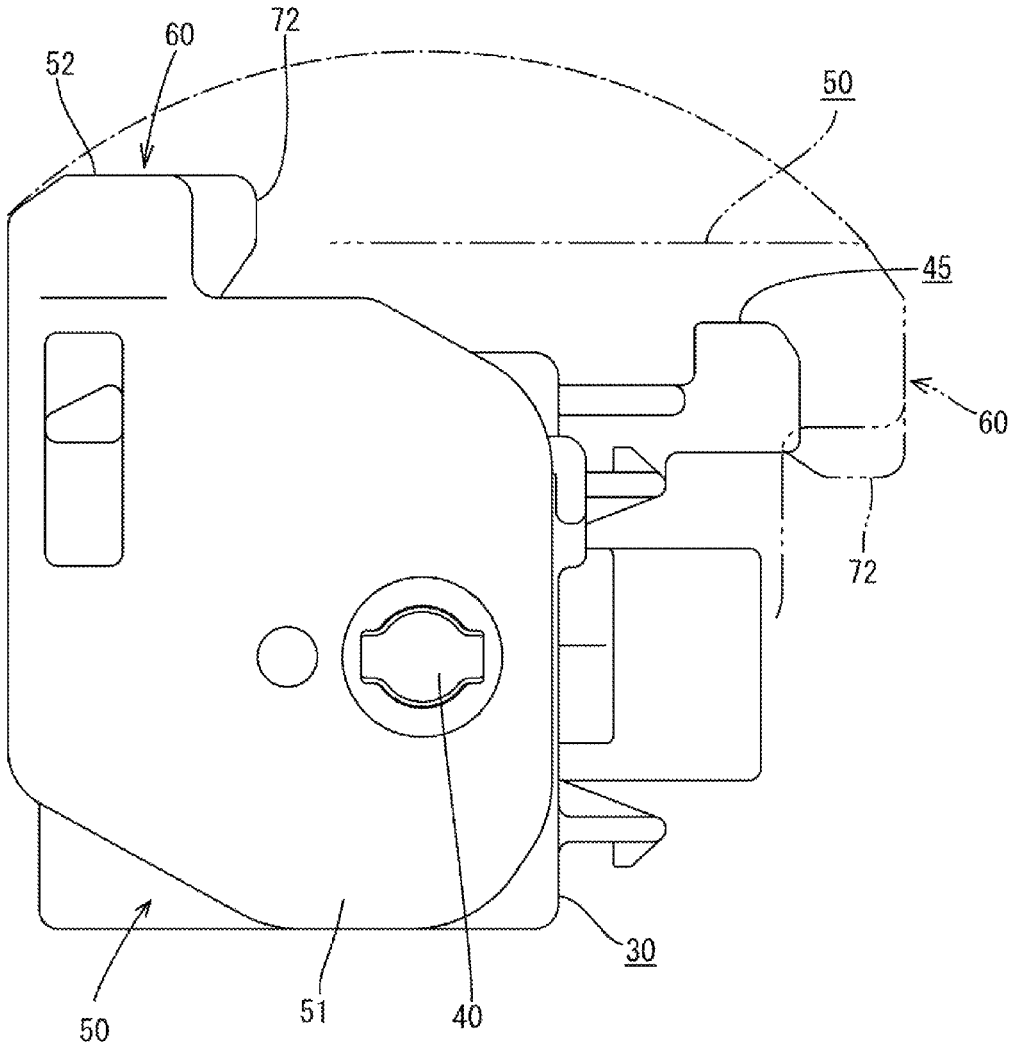
FIG. 5 is a side view showing the state of FIG. 2.

As shown in FIGS. 2 to 4, a lock 60 is at a central part of the operating portion 52 of the lever 50 and locks the lever 50 at the end position. The following description is based on the lever 50 being at the initial position shown in solid line in FIGS. 1 and 5.

A lock piece accommodation space 61 of predetermined width penetrates through the central part of the operating portion 52 in forward and backward directions. A finger placing portion 63 having an uneven surface is formed at a front upper position in the lock piece accommodation space 61, as shown in FIGS. 1 and 2.

Figure 9:
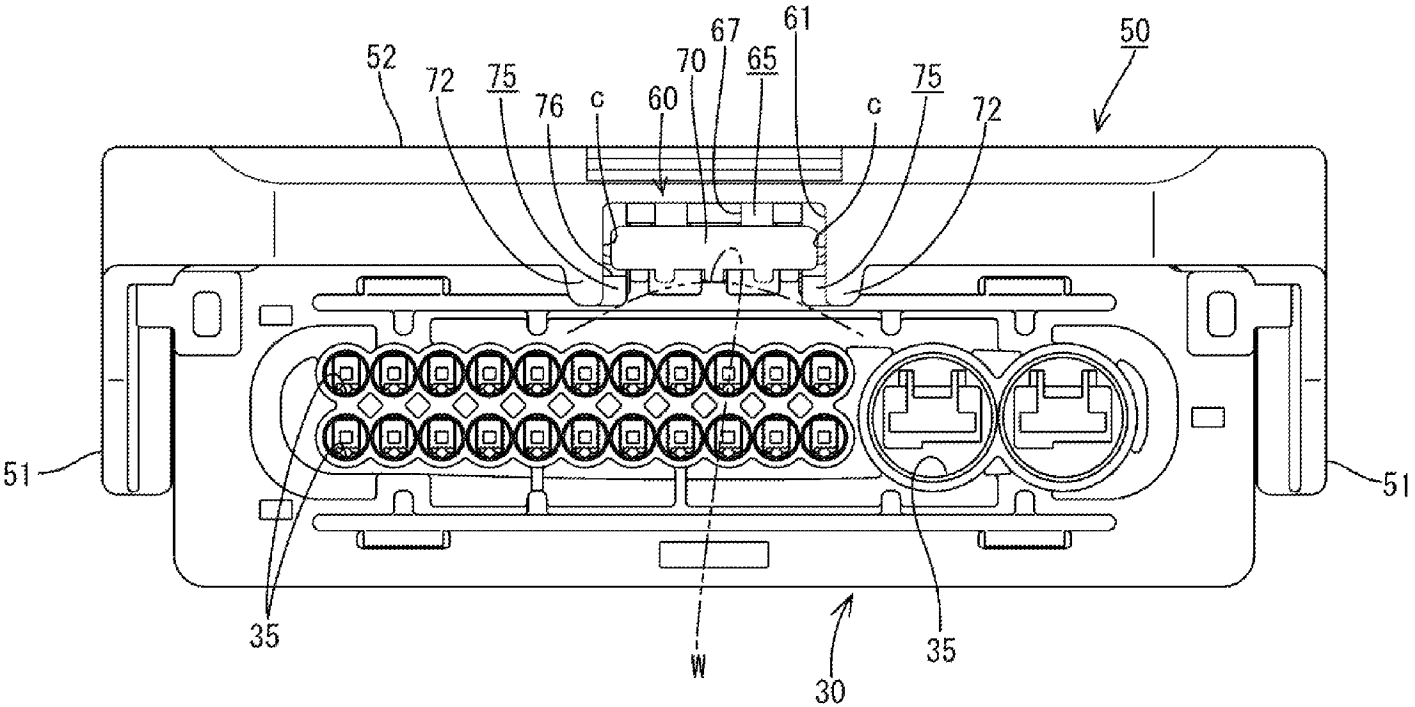
FIG. 9 is a rear view showing a state where the lever is held at an end position.

A lock piece 65 is cantilevered obliquely up toward the back in the lock piece accommodation space 61 and can deflect resiliently about a base 62 provided at a front lower position in the lock piece accommodation space 61. The lock piece 65 has a main portion 66 formed with a lock hole 67 and a locking surface 68 is formed at the front of the lock hole 67. An unlocking portion 70 is formed on the upper surface of a tip of the lock piece 65 and is operable by a finger to deflect the lock piece 65 resiliently in an unlocking direction. This unlocking portion 70 is wider than the main portion 66 of the lock piece 65 and clearances c are defined between the unlocking portion 70 and left and right side surfaces of the lock piece accommodation space 61, as shown in FIG. 9.

Figure 7:
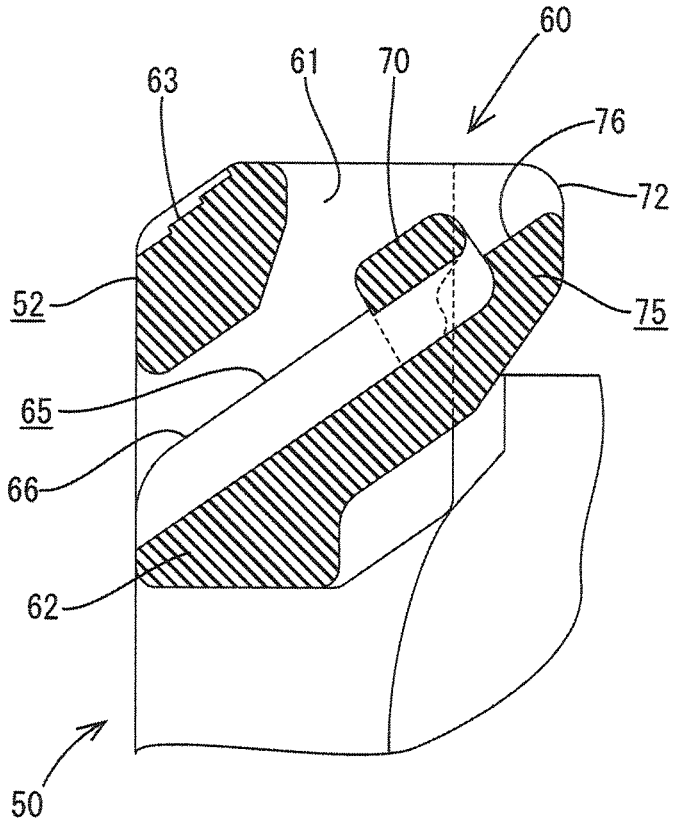
FIG. 7 is an enlarged section along VII-VII of FIG. 6.

A tip of the lock piece 65, including the unlocking portion 70, projects slightly back from the rear edge of the lock piece accommodation space 61. Accordingly, protection walls 72 project back from the operating portion 52, as shown in FIG. 7, (down at the position shown in FIG. 8) to protect the unlocking portion 70. The two protection walls 72 face the side surfaces of the unlocking portion 70 at the tip of the lock piece 65.

The lock engaging portion 45 is formed on an end of a supporting plate 46 that projects horizontally back from a central part of the female housing 30, as shown in FIGS. 3 and 4, and is to be engaged with the lock 60. A block-shaped engaging protrusion 47 projects up on the lock engaging portion 45.

Engaging walls 48 are formed on opposite left and right side surfaces of this engaging protrusion 47 to protect the engaging protrusion 47 and can fit into the lock piece accommodation space 61. A protrusion 49 is formed between the engaging walls 48 and can fit into the lock hole 67 of the lock piece 65.

Figure 8:
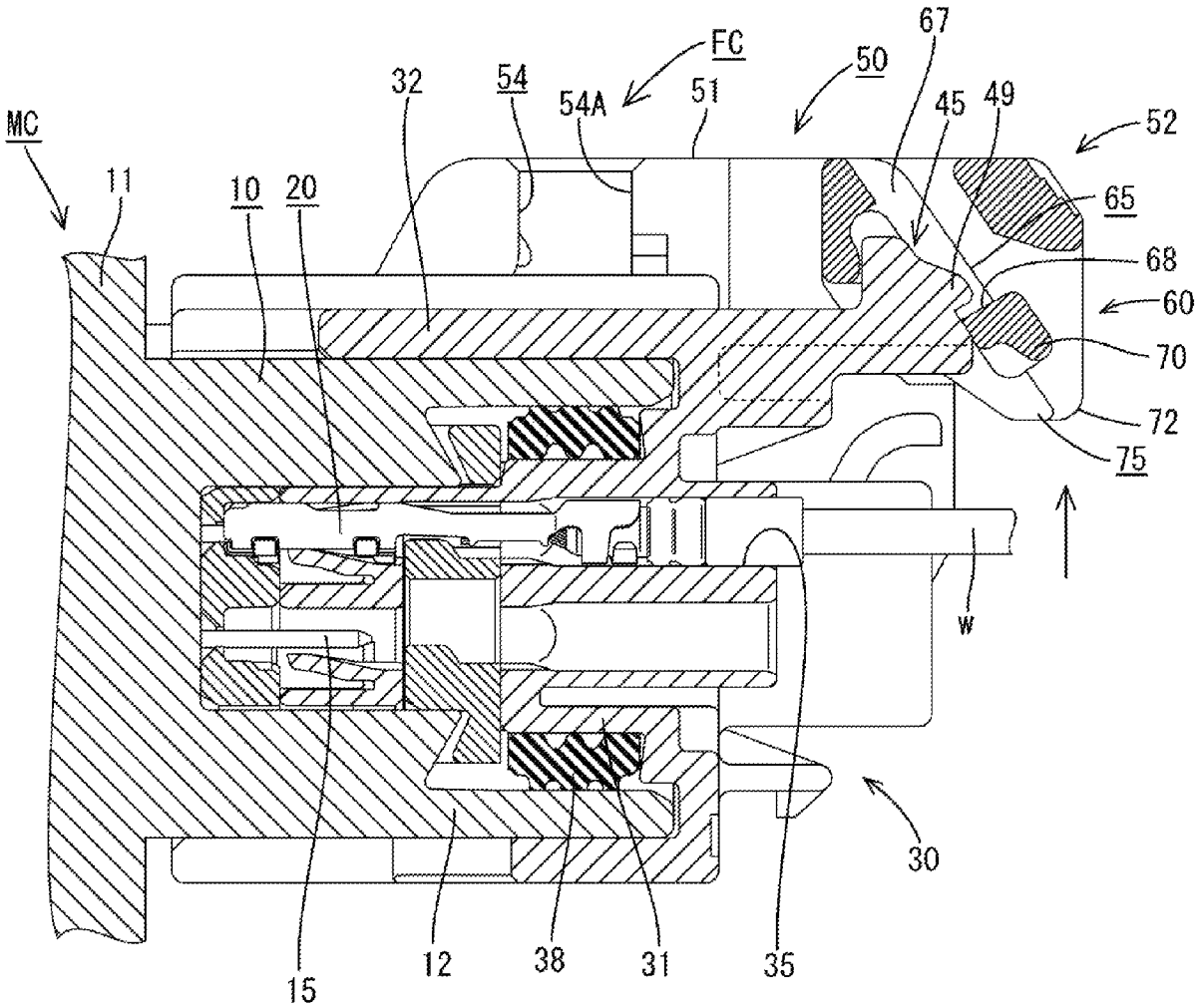
FIG. 8 is a longitudinal section when the connection of the male and female connectors is completed.

The lock 60 contacts the lock engaging portion 45 when the housings 10, 30 are connected properly, i.e. when the lever 50 is rotated to the end position, as shown in FIG. 8. At this time, the locking surface 68 at the front of the lock hole 67 in the lock piece 65, moves onto the protrusion 49 and the lock piece 65 is inserted between the engaging walls 48 while being resiliently deflected. The protrusion 49 fits into the lock hole 67 and engages the locking surface 68 when the lock piece 65 passes over the protrusion 49.

A finger can hook the unlocking portion 70 at the tip of the lock piece 65 and forcibly deflect the lock piece 65 to move the protrusion 49 out of the lock hole 67 and to release the locked state so that the lever 50 can rotate toward the initial position.

Figure 6:
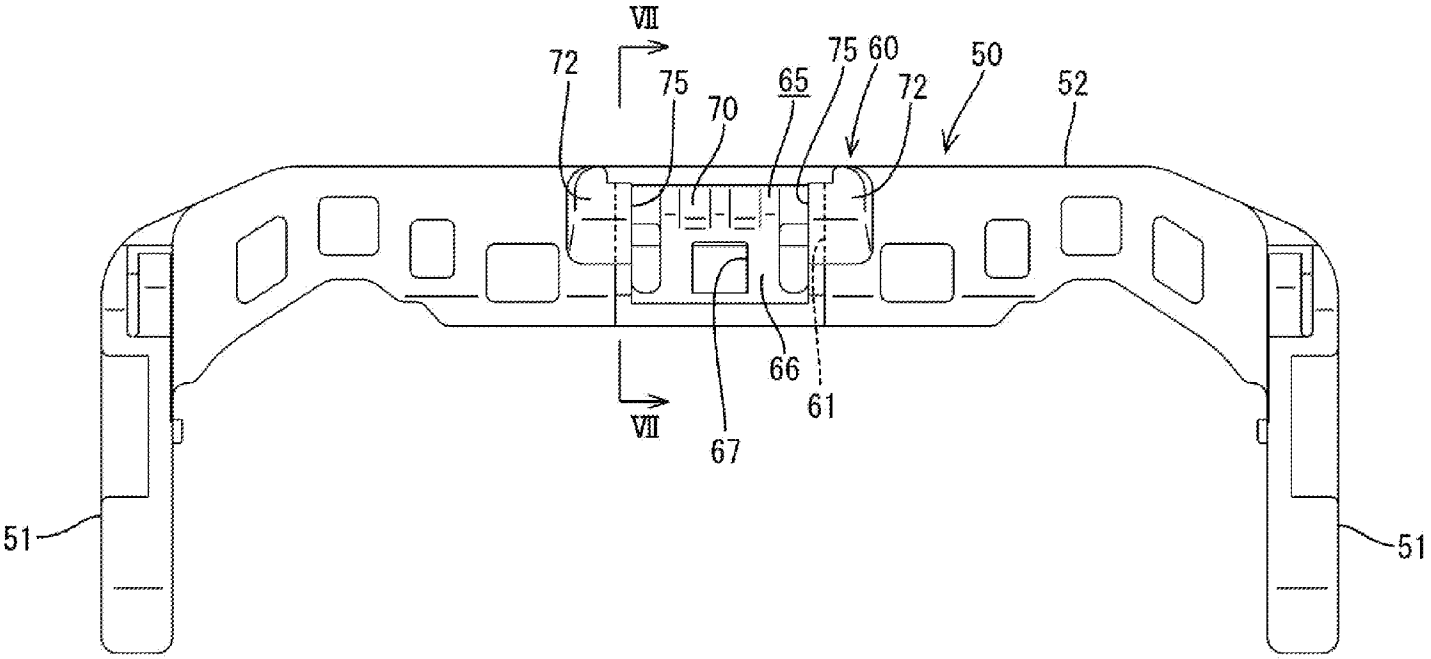
FIG. 6 is a rear view of the lever.

A measure is taken to narrow a front opening between the protection walls 72 in the lock 60. Specifically, as shown in FIGS. 1, 6 and 7, entrance restricting projections 75 are formed on lower parts of the side surfaces of the protection walls 72 to face each other at a lower area of the lock piece accommodation space 61. As shown in FIG. 7, an upper surface 76 of each entrance restricting portion 76 is inclined down toward the front in conformity with an inclined posture of the lock piece 65. Each entrance restricting projection 75 extends from the base 62 parallel to the lock piece 65 until reaching the rear edge of the protection wall 72.

Tips of the entrance restricting projections 75 protect left and right sides of the unlocking portion 70 of the lock piece 65 behind the unlocking portion 70 when the wires w (wire group W) drawn out from the rear of the female housing 30 are pulled as shown in FIG. 9 while the lever 50 is locked by the lock 60 as shown in FIGS. 8 and 9.

The male and female connectors MC, FC can be connected by moving the lever 50 to the initial position on the female housing 30 and positioning the female housing 30 relative to the male housing 10, as shown by an arrow of FIG. 1. The cam pins of the male housing 10 enter the cam grooves 54 on the arms 51 of the lever 50 in an early stage of connection. A finger then is placed on the finger placing portion 63 of the operating portion 52 to rotate the lever 50 in a clockwise direction of FIG. 1. A cam action between the cam pins and the cam grooves 54 causes the female housing 30 to be pulled toward and connected to the male housing 10.

When the lever 50 is rotated to the end position, the protrusion 49 fits into the lock hole 67 of the lock piece 65 as shown in FIG. 8 to lock the lever 50. As a result, the two housings 10, 30 are held in a properly connected state.

The wires w drawn out from the rear surface of the female housing 30 may be pulled up, as shown by an arrow of FIG. 8. In such a case, without the entrance restricting projections 75, the wire group W may be pressed against the unlocking portion 70 through a space between the protection walls 72 and can deflect the lock piece 65 in the unlocking direction. However, the entrance restricting projections 75 project from the facing surfaces of the protection walls 72 at the entrance side. Thus, as shown in FIG. 9, the wire group W that is pulled up contacts the entrance restricting projections 75 and is restricted from entering the space between the protection walls 72. As a result, the wire group W cannot be pressed against the unlocking portion 70. In this way, the lock piece 65 is held in a state where the lever 50 is locked, and an unintended rotation of the lever 50 toward the initial position is prevented. Note that, fingers of an operator, external matter and the like also will contact the entrance restricting projections 75 to restrict entry.

The male and female connectors MC, FC may have to be separated for maintenance or the like. Thus, the lock piece 65 is deflected up by hooking a finger on the unlocking portion 70 in the state shown in FIG. 8 so that the protrusion 49 comes out of the lock hole 67 and is released from the locked state. The lever 50 then is rotated toward the initial position, and the female housing 30 gradually separates from the male housing 10 by the cam action between the cam pins and the cam grooves 54. The female housing 30 is pulled further back after the lever 50 is rotated to the initial position and is separated from the male connector MC while the cam pins come out of the cam grooves 54.

The entrance restricting projections 75 project from the facing surfaces of the protection walls 72 behind the unlocking portion 70 of the lock piece 65 to narrow the entrance toward the unlocking portion 70 in the unlocking direction. Thus, the wires w, external matter and the like moved toward the lock engaging portion 45 are restricted from entering the space between the protection walls 72 and cannot press against the unlocking portion 70 at the tip of the lock piece 65. Therefore, the lock piece 65 is held in a state of locking the protrusion 49. As a result, the locked state is not released inadvertently by the pulled wires w, external matter or the like and consequently the lever 50 is prevented from unintentionally rotating toward the initial position.

The invention is not limited to the above described embodiment. For example, the following embodiments also are included in the scope of the invention.

The entrance restricting portions on the facing surfaces of the protection walls may not overlap the left and right side edges of the unlocking portion of the lock piece and may have a projecting length not to reach the left and right side edges.

The invention is applicable to a connector with a lever on a male housing.

What is claimed is:

1. A lever-type connector, comprising:

a housing into which a terminal fitting connected to an end of a wire is inserted from behind;

a lever having two arms extending from an operating portion to define a U-shape, the arms being mounted rotatably on side surfaces of the housing, each arm including a cam groove configured to enable connection with a mating housing while rotating the lever from an initial position to an end position;

a locked portion protruding from a rear surface of the housing; and a lock provided on the operating portion of the lever and including a resiliently deflectable cantilevered lock piece, an unlocking portion on a tip of the lock piece and protection walls standing on opposite sides of the lock piece in a direction perpendicular to a deflecting direction with clearances defined between the protection walls and the lock piece; wherein:

the lock piece of the lock resiliently locks the locked portion to hold the lever at the end position, and the locked portion is released from a locked state and the lever is permitted to rotate toward the initial position by pulling up the unlocking portion and deflecting the lock piece;

entrance restricting projections projecting from facing surfaces of the protection walls on an end position of the unlocking portion of the lock piece in the lock; and the entrance restricting projections overlap opposite edges of the unlocking portion when the housing is viewed from behind in a state where the lever is at the end position.

2. The lever-type connector of claim 1, wherein the protection walls are substantially perpendicular to a rotational axis of the lever.

3. The lever-type connector of claim 1, wherein the lock piece is deflectable about an axis substantially parallel to a rotational axis of the lever.

4. The lever-type connector of claim 1, wherein the protection walls and the unlocking portion of the lever project rearward of the housing when the lever is in the end position.

5. A lever-type connector, comprising:

a housing into which a terminal fitting connected to an end of a wire is inserted from behind;

a lever having two arms extending from an operating portion to define a U-shape, the arms being mounted rotatably on side surfaces of the housing, each arm including a cam groove configured to enable connection with a mating housing while rotating the lever from an initial position to an end position;

a locked portion protruding from a rear surface of the housing; and a lock provided on the operating portion of the lever and including a resiliently deflectable cantilevered lock piece, an unlocking portion on a tip of the lock piece and protection walls standing on opposite sides of the lock piece in a direction perpendicular to a deflecting direction with clearances defined between the protection walls and the lock piece; wherein:

the lock piece of the lock resiliently locks the locked portion to hold the lever at the end position, and the locked portion is released from a locked state and the lever is permitted to rotate toward the initial position by pulling up the unlocking portion and deflecting the lock piece;

entrance restricting projections projecting from facing surfaces of the protection walls on an end position of the unlocking portion of the lock piece in the lock; and projecting distances of the entrance restricting projections from the protection wall is greater than a clearance between the respective protection wall and the unlocking portion of the lever.

6. A lever-type connector, comprising:

a housing having opposite front and rear ends and configured for receiving a terminal fitting, at least one support shaft between the front and rear ends of the housing, and a locked portion protruding at the rear end of the housing; and a lever with at least one arm mounted rotatably on the support shaft of the housing and an operating portion spaced from the support shaft, the arm including a cam groove configured to facilitate connection with a mating housing while rotating the lever from an initial position to an end position, a lock on the operating portion of the lever and including a resiliently deflectable cantilevered lock piece engageable with the locked portion on the housing when the lever is at the end position, an unlocking portion on a tip of the lock piece, protection walls on opposite sides of the lock piece and entrance restricting projections projecting from facing surfaces of the protection walls at positions for restricting access to the unlocking portion of the lock piece, wherein projecting distances of the entrance restricting projections from the protection wall is greater than a spacing between the respective protection wall and the unlocking portion of the lever.

7. The lever-type connector of claim 6, wherein the entrance restricting projections overlap opposite edges of the unlocking portion when the housing is viewed from behind in a state where the lever is at the end position.

8. The lever-type connector of claim 6, wherein the at least one arm comprises two parallel arms projecting from the operating portion so that the lever is substantially U-shaped.

9. The lever-type connector of claim 6, wherein the protection walls are substantially perpendicular to a rotational axis of the lever.

10. The lever-type connector of claim 6, wherein the lock piece is deflectable about an axis substantially parallel to a rotational axis of the lever.

11. The lever-type connector of claim 6, wherein the protection walls and the unlocking portion of the lever project rearward of the housing when the lever is in the end position.

* * * * *